US008166784B2

(12) United States Patent
Tong

(10) Patent No.: US 8,166,784 B2
(45) Date of Patent: May 1, 2012

(54) PIN ASSEMBLY COVER FOR A LOCK MECHANISM AND METHOD OF USE

(75) Inventor: Mike Yueh-Ming Tong, Bellevue, WA (US)

(73) Assignee: GMS Industries, Inc., Redmond, WA (US)

( * ) Notice: Subject to any disclaimer, the term of this patent is extended or adjusted under 35 U.S.C. 154(b) by 0 days.

(21) Appl. No.: 12/731,389

(22) Filed: Mar. 25, 2010

(65) Prior Publication Data

US 2011/0232342 A1 Sep. 29, 2011

(51) Int. Cl.
*E05B 9/04* (2006.01)
*E05B 17/20* (2006.01)
*E05B 17/18* (2006.01)

(52) U.S. Cl. ..... 70/493; 70/449; 70/373; 70/448

(58) Field of Classification Search ..... 70/372–374, 70/493–495, 447–449, DIG. 15
See application file for complete search history.

(56) References Cited

U.S. PATENT DOCUMENTS 1,477,318 A * 12/1923 Crass ..... 70/493
1,888,954 A * 11/1932 Keil ..... 70/367
3,656,328 A * 4/1972 Hughes ..... 70/276
4,732,022 A * 3/1988 Oliver ..... 70/406
5,177,466 A * 1/1993 Lai ..... 340/542
6,910,356 B2 * 6/2005 Price ..... 70/358
7,673,484 B1 * 3/2010 Crepinsek ..... 70/419

* cited by examiner

*Primary Examiner* — Lloyd Gall
*Assistant Examiner* — Ifeolu Adeboyejo
(74) *Attorney, Agent, or Firm* — Michael J. Donohue; Davis Wright Tremaine, LLP

(57) ABSTRACT

A lock mechanism includes a cover plate positionable over a plurality of pin chambers in a cylinder housing wherein one or more of the pin chambers include an internal threaded portion. The lock mechanism includes one or more pin assembly caps that are operative to secure the cover plate to the cylinder housing of the lock by threadably engaging with threaded pin chambers. The pin assembly caps include an internal cavity sized to receive at least a portion of a pin assembly, such that threaded pin chambers and unthreaded pin chambers have substantially the same dimensions without substantially increasing the dimensions required for the lock mechanism. The pin assembly caps include a socket (e.g., a hex socket, a Phillips-type socket, or the like) that allow users to selectively remove and secure the cover plate to the cylinder housing common tools.

23 Claims, 6 Drawing Sheets

PIN ASSEMBLY COVER FOR A LOCK MECHANISM AND METHOD OF USE

BACKGROUND OF THE INVENTION

1. Field of the Invention

The present invention is directed generally to lock mechanisms, and more specifically, to lock mechanisms that include features that permit simple and efficient access to pin assemblies and recombination of the lock mechanisms.

2. Description of the Related Art

Lock and key mechanisms have existed relatively unchanged for hundreds of years. While improvements have been made, the fundamental concept remains the same. One such lock mechanism is referred to as a pin-tumbler cylinder lock. In this type of lock, an outer housing has a cylindrical opening in which a cylindrical plug is housed. To open the lock, the cylindrical plug must rotate. The plug generally has a key slot (or "keyway") at one end to allow a key to enter the plug and a cam or lever at the other end which may activate a mechanism to retract a locking bolt. A plurality of holes are drilled vertically into the plug and contain key pins of various lengths which may be shaped to permit a key to slide over them easily.

Above each key pin is a corresponding set of driver pins that are loaded by springs. Some locks may have only one driver pin for each key pin, but other locks requiring multi-keyed entry (e.g., a master key) may have extra driver pins and/or key pins known as spacer pins. The outer housing has several vertical shafts or pin chambers, which hold the spring-loaded pins. When the plug and outer housing are assembled, the pins are pushed down into the plug by the springs. The point where the plug and cylinder meet is called the shear point. When a proper key is inserted into the key slot of the plug, the key pins rise causing them to align with the shear point, allowing the plug to rotate and the lock to open. As can be appreciated, when no key or an improper key is in the key slot, the driver pins straddle the shear point, preventing the plug from rotating.

The springs and pins may be positioned in the pin chambers of an outer housing and retained by a cover. For example, some locks use a cover that is permanently crimped over the set of springs on an outer housing. In these types of locks, the loading and unloading of pins and springs is performed by removing the cylindrical plug, not the cover. Other locks may use individual set screws or caps to secure the pins and springs inside the outer housing. These types of locks may require special tools to remove the caps or screws. Further, locks having individual caps or screws over each pin chamber may reduce the dimensions of the pin chambers, may be difficult or time consuming to remove, or may have other shortcomings. Therefore, it can be appreciated that there is a need for an improved lock mechanism that allows for simple and efficient loading and unloading of springs and pins from pin chambers. The present disclosure describes such a mechanism, which may provide these and other advantages as is described in the detailed description and accompanying figures.

BRIEF DESCRIPTION OF THE SEVERAL VIEWS OF THE DRAWING(S)

DETAILED DESCRIPTION OF THE INVENTION

Figure 1:
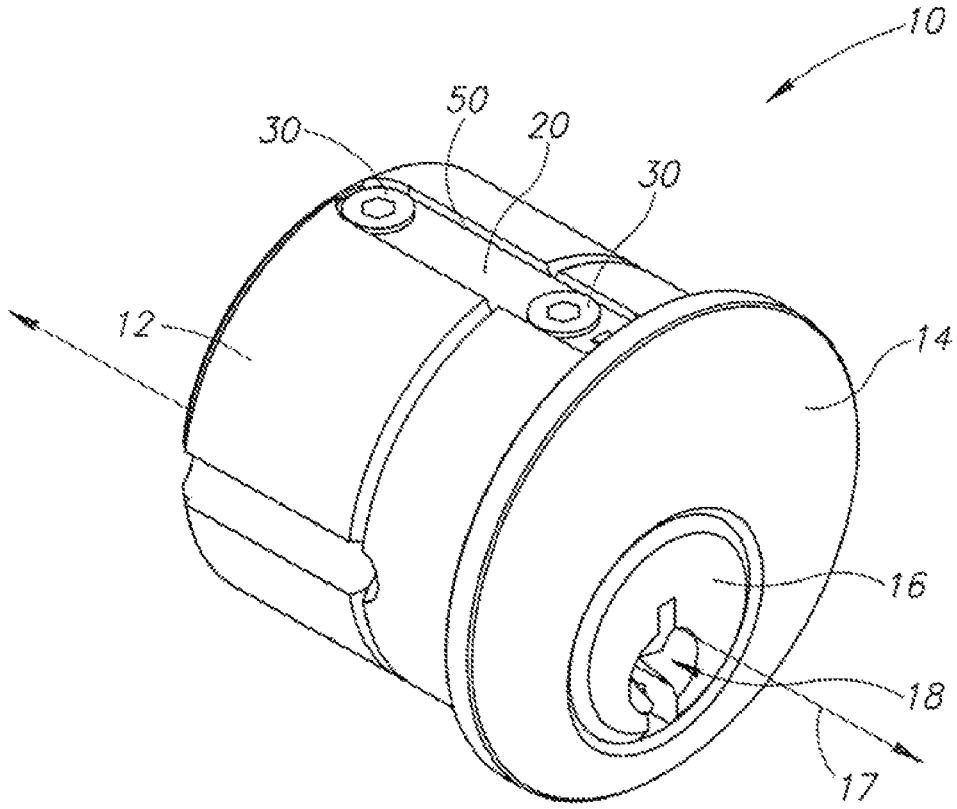
FIG. 1 is a perspective view of an exemplary pin tumbler lock.

FIG. 1 illustrates a front perspective view of a lock 10 constructed in accordance with the present teachings. For the sake of clarity, the lock 10 is shown without installation into a door or other location in which a lock would be installed. The lock 10 includes a cylinder housing 12 and a rotating member, which may be referred to as a cylinder plug 16, positioned on a front face or shoulder portion 14 of the lock 10 and rotating about an axis 17. The cylinder plug 16 includes a keyway passage 18 that is manufactured in a shape that permits insertion of a key (not shown).

Figure 2:
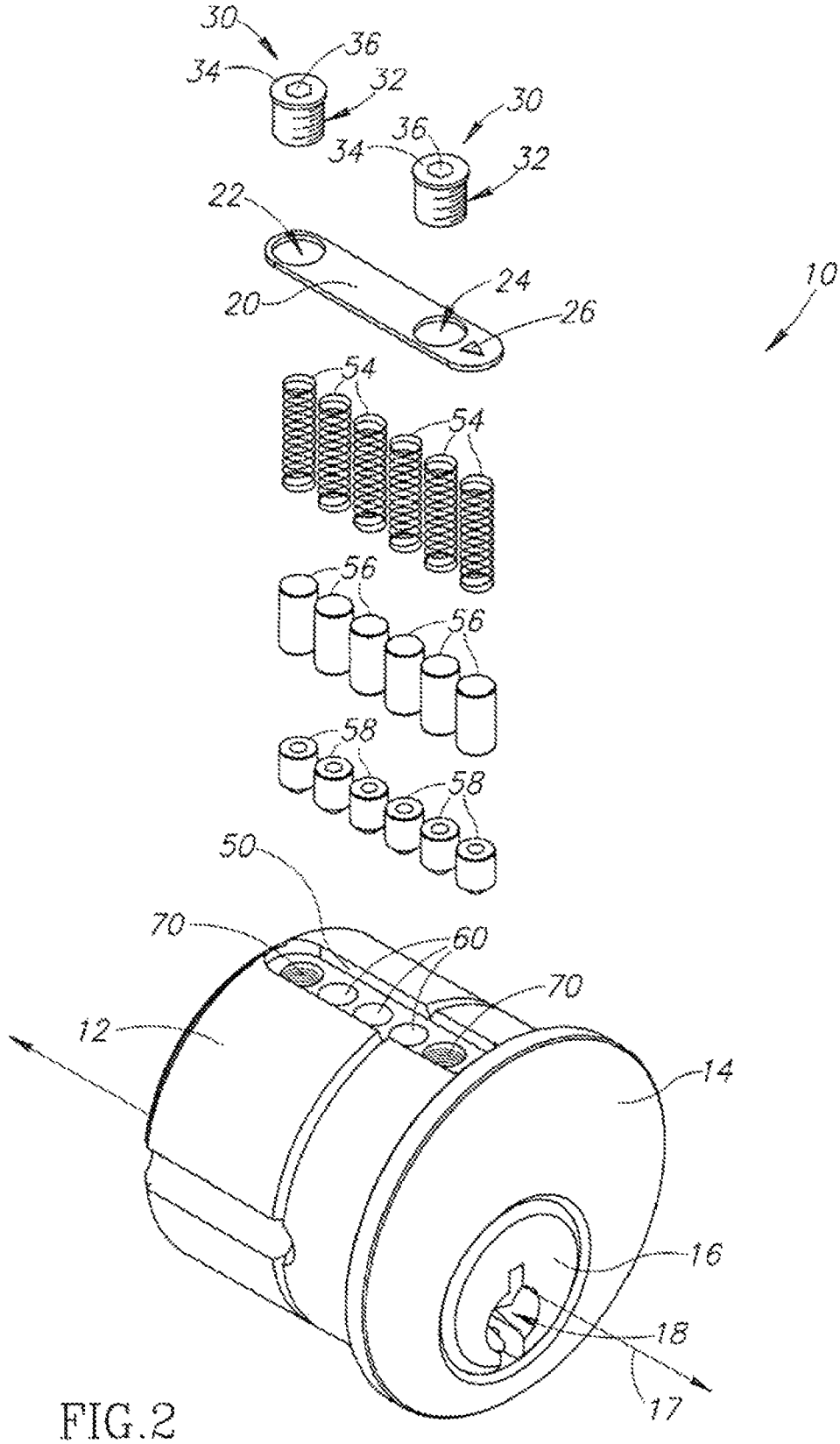
FIG. 2 is an exploded perspective view of the pin tumbler lock shown in FIG. 1.
Figure 3A:
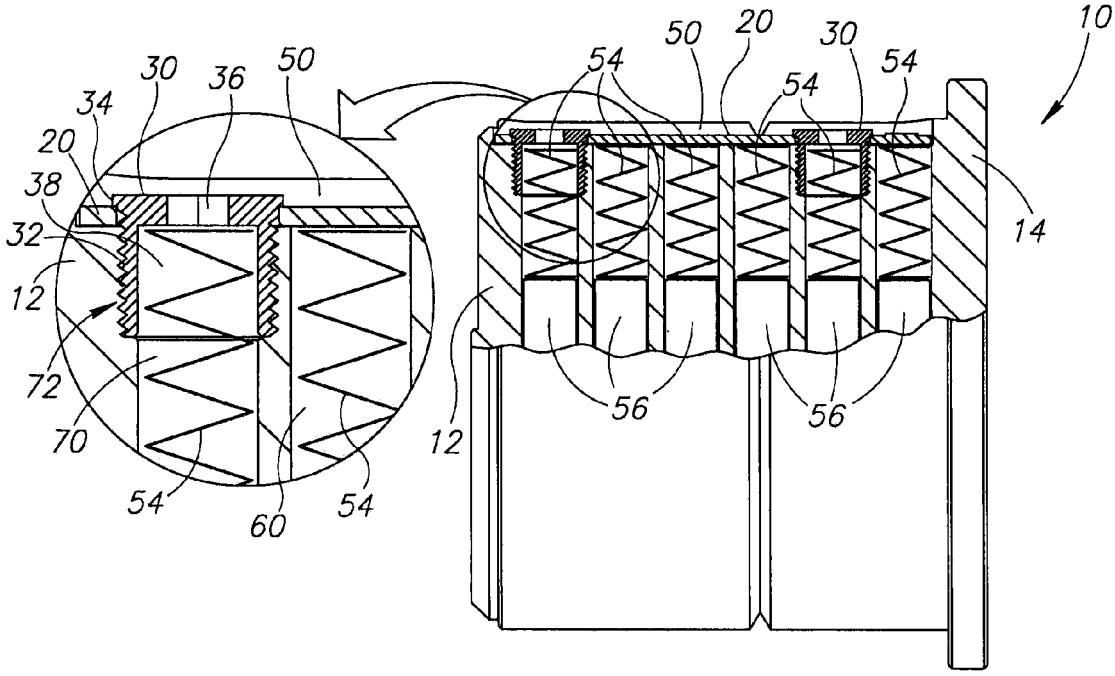
FIG. 3A is a partial side cut-away view of the pin tumbler lock shown in FIGS. 1 and 2.
Figure 3B:
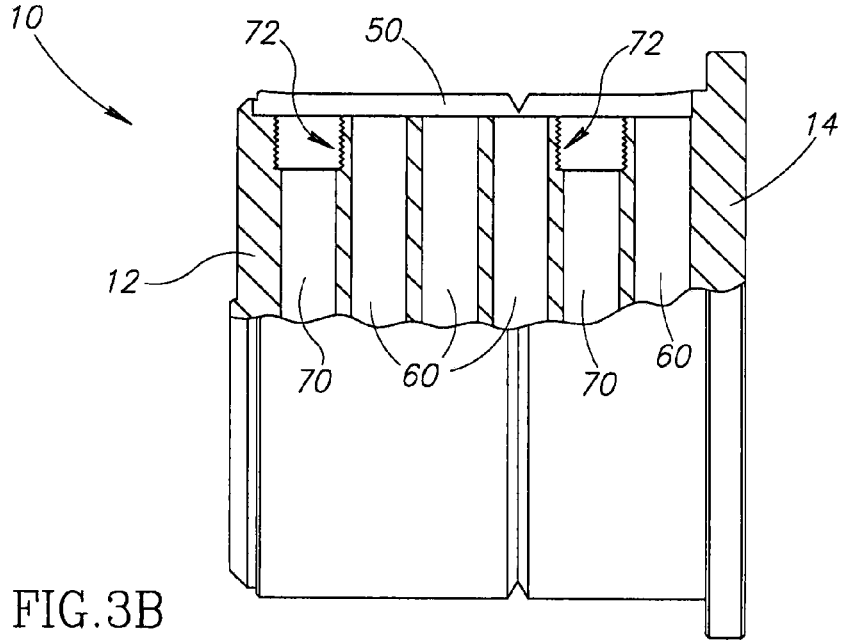
FIG. 3B is a partial side cut-away view of the pin tumbler lock shown in FIGS. 1 and 2 without the cover plate, pins, or springs.
Figure 4A:
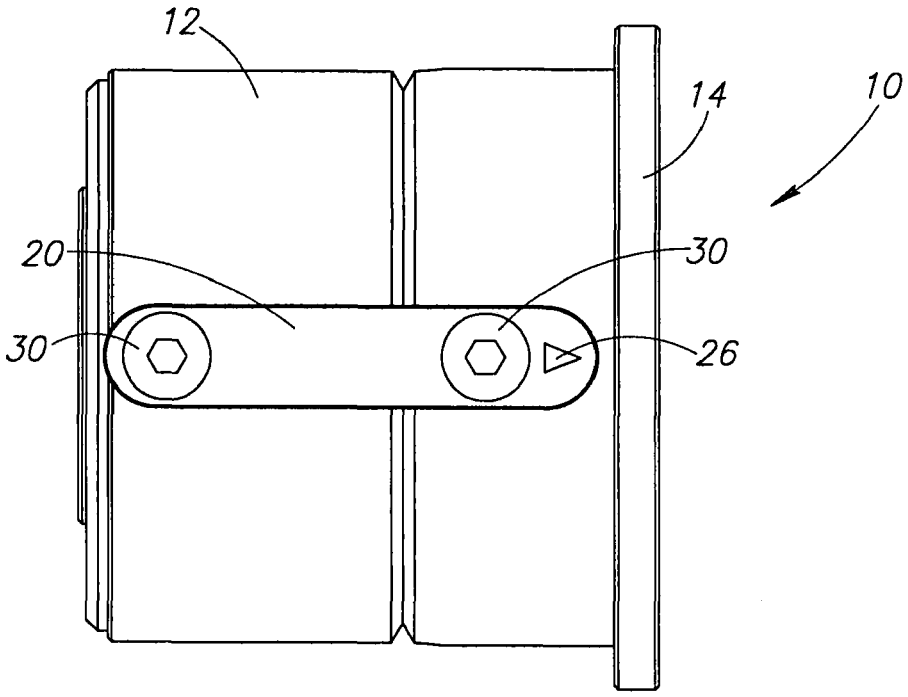
FIG. 4A is a top view of the pin tumbler lock shown in FIGS. 1 and 2.
Figure 4B:
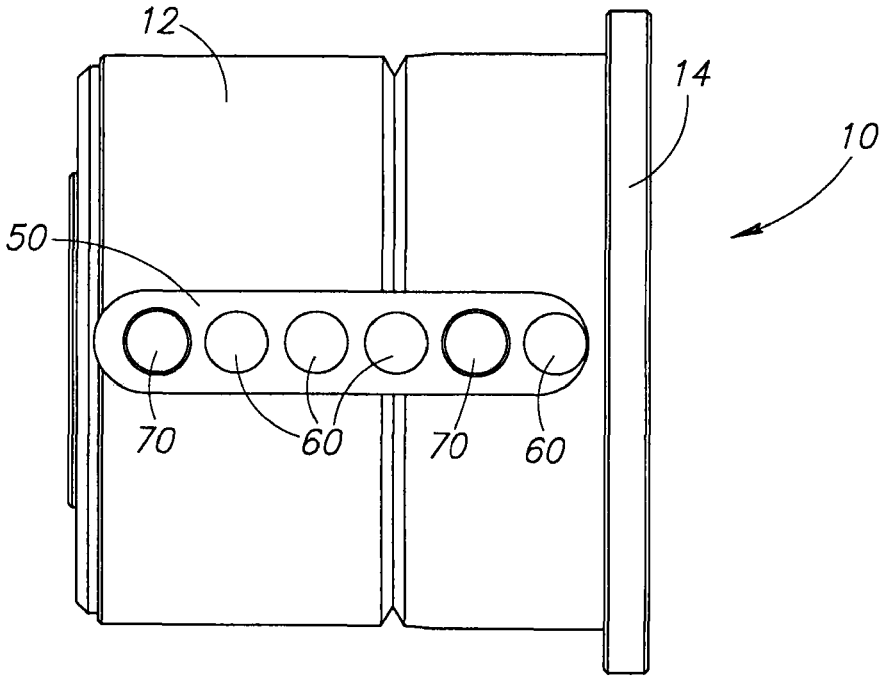
FIG. 4B is a top view of the pin tumbler lock shown in FIGS. 1 and 2 without the cover plate, pins, or springs.

FIG. 2 is an exploded front perspective view of the lock 10. FIG. 3A is a side cut-away view of the lock 10, and FIG. 3B is a side cut-away view of the lock 10 shown without any removable components in place. Further, FIG. 4A is a top view of the lock 10, and FIG. 4B is a top view of the lock 10 without any removable components in place. Although a specific lock 10 is shown and described herein, it should be appreciated that the present teaching may be applicable to a variety of types of locks including Mortise locks, IC core locks, knob assembly locks, and the like.

As may best be viewed in FIGS. 2, 3A, and 3B, a plurality of pin chambers 60, 70 are bored into the cylinder housing 12 and plug 16 (the plug pin chambers not shown). As can be seen in FIG. 3B, the pin chambers 70 each include an internal threaded portion 72 near an external surface of the cylinder housing 12, whereas the pin chambers 60 are unthreaded. Within each of the pin chambers 60, 70 is a spring 54, a driver pin 56 abutting the spring 54 at one end, and a key pin 58 (see FIG. 2) abutting the driver pin 56 at the end of the driver pin 56 opposite the spring 54. Collectively, a set including a spring 54, a driver pin 56, and a key pin 58 inside each pin chamber 60, 70 may generally be referred to as a "pin assembly."

Although other shapes are possible, the pin chambers 60, 70, driver pins 56 and key pins 58 are generally circular in cross-section. The driver pins 56 are generally cylindrical in shape with all driver pins having identical lengths. In some embodiments, the pin chambers 60, 70 include driver pins with different lengths such that, at rest, the combined stacks of driver pins 56 and key pins 58 are the same overall length. In this manner, the springs 54 are compressed by the same amount while at rest. The key pins 58 are generally cylindrical in shape at the end that abuts the corresponding driver pin 56. The opposite end of each key pin 58 may be tapered such that each key pin 58 may be pushed out of its resting position when a key contacts the tapered end. As can be appreciated, different quantities and sizes of springs, key pins, and driver pins may be included in each pin assembly. For example, in the case where a lock is manufactured to allow different keys to open the lock (e.g., a master key and a user key), each pin assembly may include a key pin and/or multiple driver pins. In one embodiment, the springs 54 are coil springs, but other forms of a resilient member may be used instead of coil springs. Functionally, the springs 54 bias the driver pins 56 and the key pins 58 toward the keyway passage 18 of the cylinder plug 16.

Figure 5:
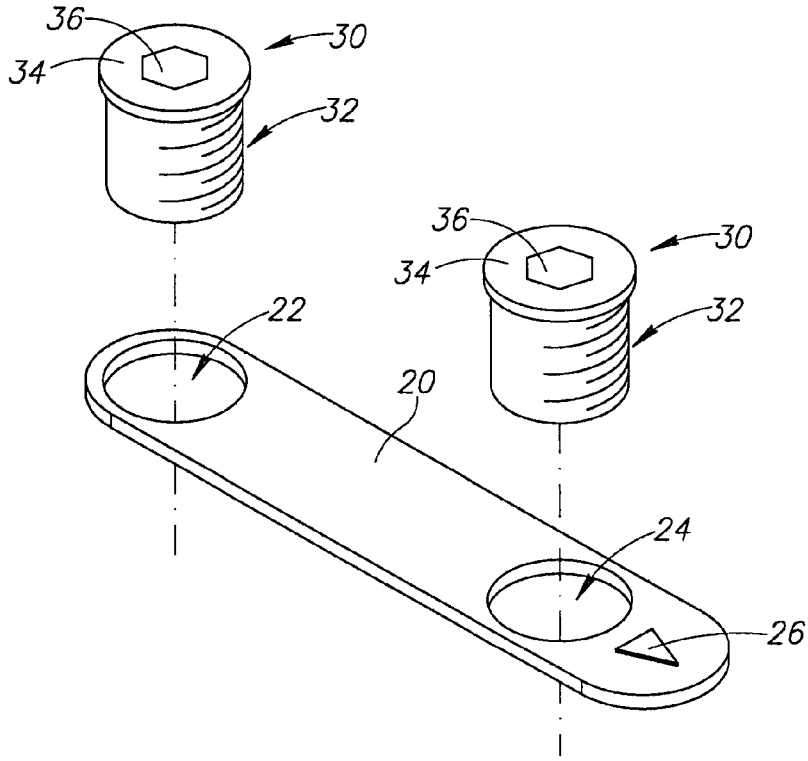
FIG. 5 is an unassembled perspective view of a cover plate and pin assembly caps including a hex socket that form part of the pin tumbler lock.
Figure 6:
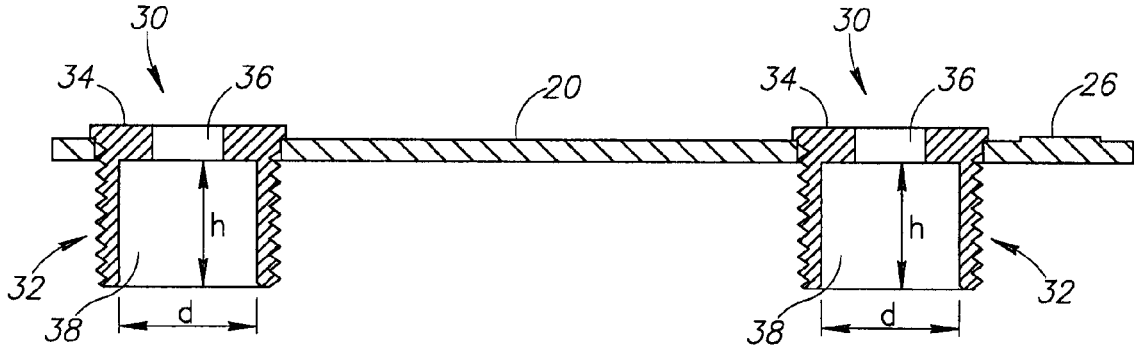
FIG. 6 is an assembled, side cut-away view of the cover plate and pin assembly caps shown in FIG. 5.

To retain the position of the pin assemblies within each of the pin chambers 60, 70 and to load the springs 54, a cover plate 20 and pin assembly caps 30 are provided. The cover plate 20 and pin assembly caps 30 may best be viewed in FIGS. 5 and 6. The cover plate 20 is sized to be positioned into a recessed portion 50 (see FIG. 2) of the cylinder housing 12 and over the pin chambers 60, 70, and includes apertures 22 and 24 that are aligned with the threaded pin chambers 70. The recessed portion 50 may also serve to retain the cover plate 20 in a position by preventing rotational movement of the cover plate. With this feature, the cover plate 20 may be held in position by one or more pin assembly caps 30.

The cover plate 20 may also include an indicator 26 operative to specify the proper orientation of the cover plate 20 to a user. Generally, the pin assembly caps 30 function to secure the cover plate 20 to the cylinder housing 12 and to restrict (or "cap") corresponding pin assemblies positioned within the threaded pin chambers 70.

Figure 7:
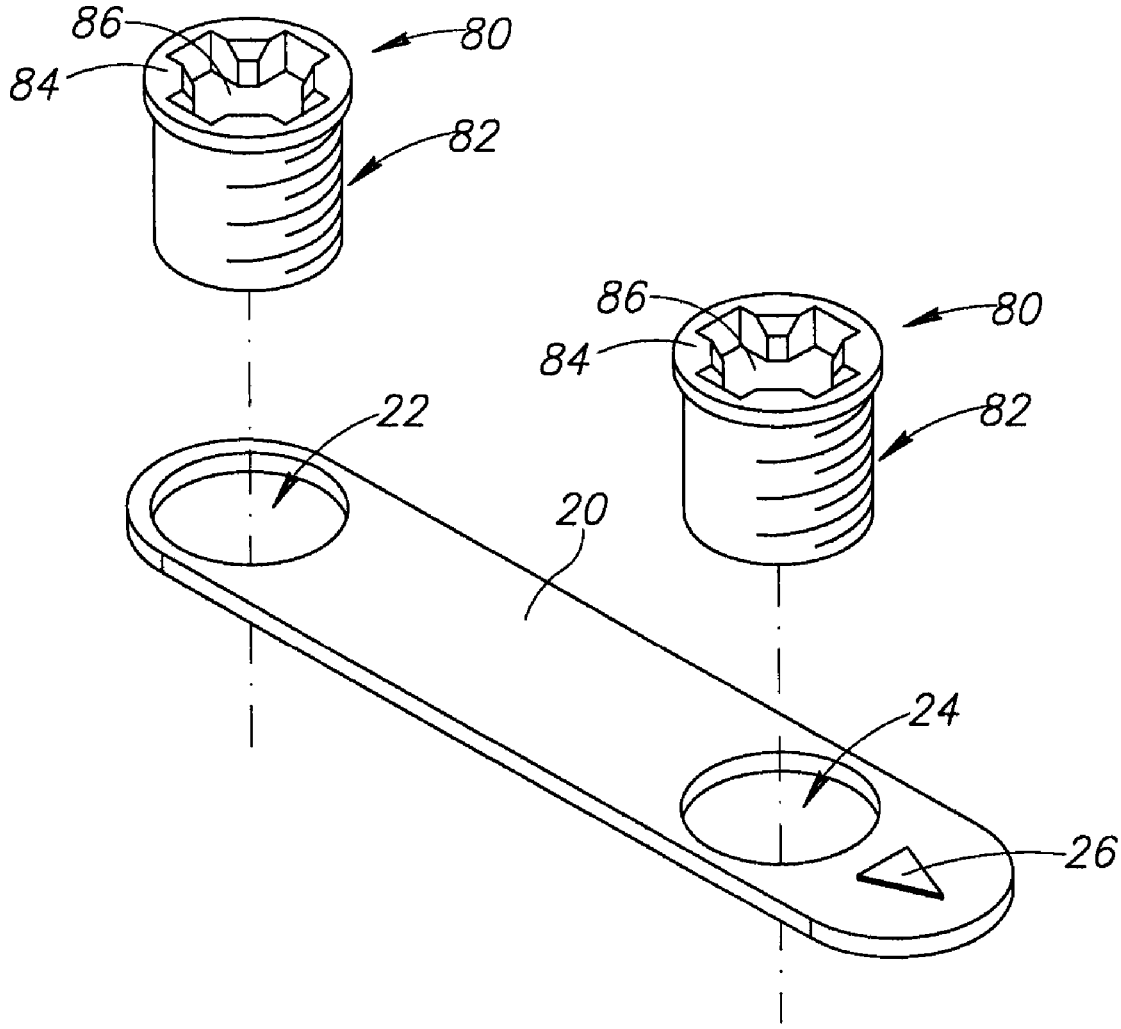
FIG. 7 is an unassembled perspective view of the cover plate and pin assembly caps including a Phillips socket that form part of the pin tumbler lock.

The pin assembly caps 30 each include a body portion 32 and a head portion 34. The body portion 32 includes external threads configured for threaded engagement with the internal threaded portion 72 of a corresponding threaded pin chamber 70. The body portion 32 also includes an internal cavity portion 38 sized to receive at least a portion of a corresponding pin assembly such that the internal cavity portion 38 forms part of the volume of the overall pin chambers 70. For example, a magnified section of FIG. 3A illustrates a portion of the spring 54 disposed inside the internal cavity portion 38 of the pin assembly cap 30. With this arrangement, the length of the pin chambers 70 is substantially equal to the length of the pin chambers 60. The pin assembly caps 30 also each include a head portion 34 that has a lip having a larger cross-sectional area than each aperture 22, 24 of the cover plate 20, thereby forming a bearing area on the underside of the lip. Further, the head portion 34 includes a hex socket 36 that allows a user to selectively rotate the pin assembly cap 30 using a common driving tool such as an hex key. Of course, other types of sockets or recesses may be used, including a slot (e.g., for a flat-blade screwdriver), a cross-shaped recess (e.g., a Phillips-type recess), a square, a star, or any other suitable configuration that permits a driving tool to apply torque to the pin assembly cap 30. For example, FIG. 7 illustrates pin assembly caps 80 that each include a head portion 84 having a Phillips-type recess 86 sized to receive a Phillips-type screwdriver. Similar to the pin assembly caps 30, the pin assembly caps 80 each include a body portion 82 having external threads and an internal cavity portion (not shown in FIG. 7).

In operation, a user may load/unload the springs 54, the driver pins 56, and the key pins 58 into the pin chambers 60, 70. The user may then position the cover plate 20 into the recessed portion 50 of the cylinder housing 12 over the pin chambers 60, 70. As best shown in FIG. 3A, the springs 54 positioned in the unthreaded pin chambers 60 abut a bottom surface of the cover plate 20. To secure the cover plate 20 to the cylinder housing 12 and to load the springs 54 positioned in the threaded pin chambers 70, a user may insert the body portion 32 of each pin assembly cap 30 into corresponding apertures 22 and 24 of the cover plate 20 and threadably engage each pin assembly cap 30 with the internal threaded portion 72 of each corresponding threaded pin chamber 70. As noted above, the lip of the head portion 34 of each pin assembly cap 30 is larger than the corresponding aperture 22 or 24 into which the pin assembly cap 30 is positioned. As can be appreciated, when each pin assembly cap 30 is threadably engaged with a pin chamber 70, the bearing area on the underside of the lip of the head portion 34 contacts the top surface of the cover plate 20 near the apertures 22 and 24 to secure the cover plate 20 to the cylinder housing 12.

The internal cavity 38 of each of the pin assembly caps 30 may be sized to provide substantially the same dimensions for each of the pin chambers 60, 70. As shown in FIG. 3A, the internal cavity 38 may have a diameter d and a height h ("or depth"). In some embodiments, the diameter d is substantially the same as a diameter of the pin chambers 60, 70. Further, the height h of the internal cavity 38 may be such that the surface of the inner cavity 38 in contact with the springs 54 (or other component of a pin assembly) is substantially aligned with a bottom surface of the cover plate 20 when in an installed position. In this regard, all of the springs 54 in the threaded pin chambers 70 and the unthreaded pin chambers 60 may be compressed by the same amount since a portion of each pin assembly (e.g., the springs 54 and possibly the driver pins 56) in the threaded pin chambers 70 is disposed within the internal cavity 38. As can be appreciated, in the absence of the internal cavity 38 in the body portion 32, the springs 54 in the threaded pin chambers 70 would be compressed more than the springs 54 in the unthreaded pin chambers 60. Although the internal cavity 38 will generally have the same diameter d as the diameter of the threaded pin chambers 70, the internal cavity 38 may be sized such that the overall dimensions of the threaded pin chambers 70 are different from the unthreaded pin chambers 60. For example, height h of the internal cavity 38 be such that the overall height of the threaded pin chambers 70 (including the internal cavity 38) is different from the height of the unthreaded pin chambers 60. Further, the diameter of the threaded pin chambers 70 may be different than the diameter of the unthreaded pin chambers 60.

Referring to FIGS. 3A and 3B, the left-most pin chamber 70 may be referred to as the "first pin chamber," the pin chamber to the right of the first pin chamber may be referred to as the "second pin chamber," and so on. In this embodiment, the first and fifth pin chambers are threaded pin chambers 70 and the second, third, fourth, and sixth pin chambers are unthreaded pin chambers 60. It should be appreciated that any other combination of threaded pin chambers 70 and unthreaded pin chambers 60 may be provided. Further, the total number of pin chambers 60 and 70 may vary (e.g., five total pin chambers, 10 total pin chambers, or the like). Also, as can be seen in FIG. 3A, the recessed portion 50 of the cylinder housing 12 may be sized such that the cover plate 20 and pin assembly caps 30 do not increase the overall space requirements for the cylinder housing 12 when installed.

Often, users (e.g., locksmiths) have a need to access pin assemblies positioned within a cylinder housing. As an example, a locksmith may access pin assemblies to recombinate a lock by changing one or more of the key pins, driver pins, and springs. The lock mechanism including the features described herein provides simple and efficient access to pin assemblies while providing other advantages as well. For example, in cases where the number of threaded pin chambers 70 is less than the total number of pin chambers, a user is only required to remove pin assembly caps 30 for the threaded pin chambers, and not all the pin chambers, which may save the user some time. Additionally, by providing pin assembly caps 30 having internal cavity portions 38, all of the springs 54 may be compressed by the same amount without substantially increasing the outer dimensions of the lock 10. Further, by providing the hex socket 36 (or other common socket) on each pin assembly cap 30, a user may remove the cover plate 20 and access pin assemblies using a common tool (e.g., a hex key), without the need for specialized equipment. Those skilled in the art will readily recognize other advantages provided by the present teachings.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A lock mechanism comprising:

a cylinder housing having a plurality of pin chambers sized to receive a pin assembly, the pin chambers including one or more threaded pin chambers having an internal threaded portion;

a cover plate removably positionable on the cylinder housing over the plurality of pin chambers, the cover plate including an aperture aligned with at least one threaded pin chamber; and a pin assembly cap having a body portion sized to fit within a corresponding aperture of the cover plate and including an external threaded portion for threaded engagement with the internal threaded portion of a corresponding threaded pin chamber, the body portion further including an internal cavity sized for receiving at least a portion of a corresponding pin assembly, the pin assembly cap further including a head portion sized to prevent passage through the corresponding aperture of the cover plate wherein the internal cavity of the pin assembly cap has a depth such that the dimensions of the plurality of pin chambers are substantially the same when the cover plate and pin assembly caps is installed on the cylinder housing.

2. The lock mechanism of claim 1 wherein the cylinder housing includes two threaded pin chambers.

3. The lock mechanism of claim 1 wherein the internal cavity of the pin assembly cap is circular in cross-section.

4. The lock mechanism of claim 1 wherein the internal cavity of the pin assembly cap has a cross-sectional area that is substantially the same as a cross-sectional area of a corresponding threaded pin chamber.

5. The lock mechanism of claim 1 wherein the head portion of the pin assembly cap includes a recess configured to receive a driving tool.

6. The lock mechanism of claim 5 wherein the pin assembly cap recess comprises a hex socket.

7. The lock mechanism of claim 5 wherein the pin assembly cap recess comprises a Phillips-type recess.

8. The lock mechanism of claim 1 wherein the cylinder housing includes a recessed portion sized to receive the cover plate.

9. A lock mechanism comprising:

a cylinder housing having an aperture extending along an axis of the cylinder housing and having a plurality of pin chambers sized to receive a pin assembly, the pin chambers including one or more threaded pin chambers having an internal threaded portion;

a cylinder plug positioned within the aperture and selectively rotatable therein about the axis, the cylinder plug having a plurality of pin chambers aligned along the axis and extending transverse to the axis, the cylinder plug pin chambers being movable into alignment with corresponding ones of the cylinder housing pin chambers, the cylinder plug having a keyway passage extending along the axis;

a cover plate removably positionable on the cylinder housing over the plurality of pin chambers, the cover plate including an aperture aligned with at least one threaded pin chamber; and a pin assembly cap having a body portion sized to fit within a corresponding aperture of the cover plate and including an external threaded portion for threaded engagement with the internal threaded portion of a corresponding threaded pin chamber, the body portion further including an internal cavity sized for receiving at least a portion of a corresponding pin assembly, the pin assembly cap further including a head portion sized to prevent passage through the corresponding aperture of the cover plate wherein the internal cavity of the pin assembly cap has a depth such that the dimensions of the plurality of pin chambers are substantially the same when the cover plate and pin assembly caps is installed on the cylinder housing.

10. The lock mechanism of claim 9 wherein the pin assemblies comprise:

at least one key pin having first and second end portions and sized to slideably fit within the cylinder plug pin chambers, the key pin having a selected length with at least some of the key pins having different lengths;

at least one driver pin sized to slideably fit within the cylinder housing pin chambers and extending into the corresponding ones of the cylinder plug pin chambers when the lock mechanism is locked, the driver pin abutting the first end portion of a respective key pin; and a spring sized to fit within the cylinder housing pin chambers and abut a respective driver pin to thereby resiliently urge the respective driver pin and the respective key pin toward the keyway passage.

11. The lock mechanism of claim 9 wherein the cylinder housing includes two threaded pin chambers.

12. The lock mechanism of claim 9 wherein the internal cavity of the pin assembly cap has a cross-sectional area that is substantially the same as a cross-sectional area of a corresponding threaded pin chamber.

13. The lock mechanism of claim 9 wherein the head portion of the pin assembly cap includes a recess configured to receive a driving tool.

14. The lock mechanism of claim 13 wherein the pin assembly cap recess comprises a hex socket.

15. The lock mechanism of claim 13 wherein the pin assembly cap recess comprises a Phillips-type recess.

16. A method comprising:

providing a lock mechanism comprising a cylinder housing having a plurality of pin chambers sized to receive a pin assembly, the pin chambers including one or more threaded pin chambers having an internal threaded portion;

positioning a cover plate on the cylinder housing over the plurality of pin chambers, the cover plate including an aperture aligned with at least one of the one or more threaded pin chambers; and securing the cover plate by threading a pin assembly cap into at least one of the one or more threaded pin chambers, the pin assembly cap having a body portion sized to fit within a corresponding aperture of the cover plate and including an external threaded portion for threaded engagement with the internal threaded portion of a corresponding threaded pin chamber, the body portion further including an internal cavity sized for receiving at least a portion of a corresponding pin assembly, the pin assembly cap further including a head portion sized to prevent passage through the corresponding aperture of the cover plate wherein the internal cavity of the pin assembly cap has a depth such that the dimensions of the plurality of pin chambers are substantially the same when the cover plate and pin assembly caps is installed on the cylinder housing.

17. The method of claim 16, further comprising:

inserting a pin assembly into at least one of the plurality of pin chambers.

18. The method of claim 16 wherein the head portion of the pin assembly cap includes a recess configured to receive a driving tool.

19. The method of claim 18 wherein the pin assembly cap recess comprises a hex socket, and wherein securing the cover plate comprises inserting a tool into the hex socket and applying a rotational force to the tool.

20. The method of claim 18 wherein the pin assembly cap recess comprises a Phillips-type recess, and wherein securing the cover plate comprises inserting a Phillips-type screwdriver into the Phillips-type recess and applying a rotational force to the tool.

21. The method of claim 16 wherein the cylinder housing of the lock mechanism includes two threaded pin chambers.

22. The method of claim 16, further comprising:

decoupling a pin assembly cap from its corresponding threaded pin chamber; and removing the cover plate from the cylinder housing.

23. The method of claim 16 wherein the internal cavity of the pin assembly cap has a cross-sectional area that is substantially the same as a cross-sectional area of a corresponding threaded pin chamber.

* * * * *